US012774875B2

(12) United States Patent
Wood, Jr. et al.

(10) Patent No.: US 12,774,875 B2
(45) Date of Patent: Oct. 27, 2026

(54) HANDGUN RECEIVER HAVING AN INTEGRATED CAMERA AND DATA TRANSMITTER

(71) Applicant: ELEVEN BRAVO TACTICAL, Charlottesville, VA (US)

(72) Inventors: Paul E. Wood, Jr., Schuyler, VA (US); Laith Vincent, Charlottesville, VA (US); Larry Wood, Earlysville, VA (US)

(73) Assignee: Elevan Bravo Tactical, Charlottesville, VA (US)

( * ) Notice: Subject to any disclaimer, the term of this patent is extended or adjusted under 35 U.S.C. 154(b) by 0 days.

(21) Appl. No.: 19/008,531

(22) Filed: Jan. 2, 2025

(65) Prior Publication Data

US 2025/0251223 A1 Aug. 7, 2025

Related U.S. Application Data

(60) Provisional application No. 63/616,796, filed on Jan. 1, 2024.

(51) Int. Cl.
*F41J 5/10* (2006.01)
*F41G 1/35* (2006.01)

(52) U.S. Cl.
CPC . *F41J 5/10* (2013.01); *F41G 1/35* (2013.01)

(58) Field of Classification Search
CPC ..... F41J 5/10; F41G 1/35
USPC ..... 42/84
See application file for complete search history.

(56) References Cited

U.S. PATENT DOCUMENTS

| | | | | |
|---|---|---|---|---|
| 5,343,650 | A | 9/1994 | Swan | |
| 6,565,226 | B1 | 5/2003 | Cummings | |
| 7,584,569 | B2 | 9/2009 | Kallio et al. | |
| 7,954,273 | B1 | 6/2011 | Swan | |
| 9,488,437 | B1 | 11/2016 | Schnog | |
| 9,846,007 | B2 * | 12/2017 | Young | F41J 5/10 |
| 9,851,083 | B2 | 12/2017 | Pinilla | |
| 10,788,289 | B1 * | 9/2020 | Wallace | F41J 5/10 |
| 2014/0000145 | A1 | 1/2014 | Merritt et al. | |
| 2016/0165192 | A1 * | 6/2016 | Saatchi | H04N 7/185 386/227 |
| 2017/0268842 | A1 | 9/2017 | Kennair, Jr. | |
| 2017/0321990 | A1 | 11/2017 | Taylor et al. | |
| 2017/0372445 | A1 | 12/2017 | Nielsen et al. | |
| 2018/0224230 | A1 * | 8/2018 | Myers | F41C 27/00 |
| 2018/0299217 | A1 * | 10/2018 | Hedeen | F41A 9/62 |
| 2019/0208092 | A1 * | 7/2019 | Patton | H04N 23/54 |
| 2019/0339042 | A1 * | 11/2019 | Gull | F41G 1/32 |
| 2021/0136277 | A1 * | 5/2021 | McFarlane | H04N 23/61 |
| 2025/0102255 | A1 * | 3/2025 | Allan | F41A 17/54 |

* cited by examiner

*Primary Examiner* — Samir Abdosh
(74) *Attorney, Agent, or Firm* — VanceIP

(57) ABSTRACT

In some aspects there is described a handgun receiver having an integrated camera, data transmitter, and power source.

22 Claims, 2 Drawing Sheets

HANDGUN RECEIVER HAVING AN INTEGRATED CAMERA AND DATA TRANSMITTER

FIELD OF THE INVENTION

In some aspects there is described a handgun receiver that has an integrated camera, data transmitter, and power source.

BACKGROUND OF THE INVENTION

Law enforcement shootings can be highly controversial and difficult to investigate. There is often a discrepancy between the accounts of those involved. While law enforcement officers now typically wear body cameras, these cameras may or may not capture the discharge of an officer's weapon (e.g., a handgun). For example, the body camera can be directed away from the aim of the weapon. So, it would be beneficial for all parties involved to be able to record the view of an officer's weapon, specifically the view of a handgun prior to discharge.

In view of the above, handgun users would benefit from handguns having integrated cameras capable of recording the handgun's viewpoint and a data transmitter for storing and/or transmitting the images captured by the camera.

SUMMARY OF THE INVENTION

In some aspects, there is described a novel handgun receiver, comprising a camera and rechargeable power source integrated into the distal end thereof (e.g., located in front of the trigger guard) and a data transmitter capable of storing and/or transmitting images captured by the camera.

In some aspects, the receiver further comprises a light and/or a laser sight.

These and other aspects, which will become apparent during the following detailed description, have been achieved by the inventor's discovery of the presently described handgun receivers.

DETAILED DESCRIPTION OF THE INVENTION

Figure 1:
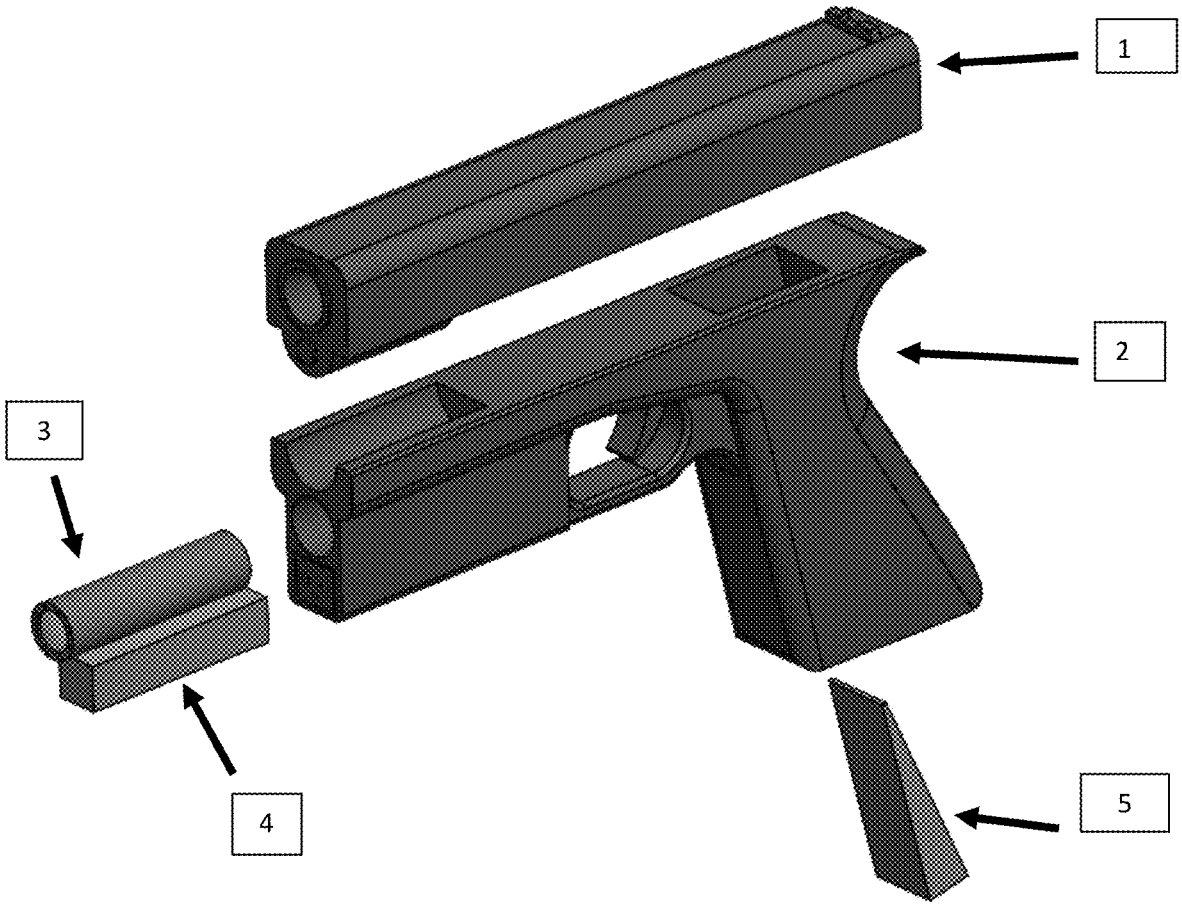
FIG. 1 shows an exploded view of a modified Glock 22.

The descriptions of the present invention have been simplified to illustrate elements that are relevant for a clear understanding of the present invention, while eliminating, for the purpose of clarity, many other elements found in typical handguns (e.g., see a parts lists for a Glock 22). Those of ordinary skill in the art will recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art. Furthermore, the aspects identified herein are for exemplary purposes only, and are not meant to be exclusive or limited in their description of the present invention.

A handgun as defined herein is a firearm that can be operated with one hand (though a second hand could be used to aim and/or stabilize). Handguns typically include a receiver (or frame) which houses the firing components (e.g., hammer, firing pin, etc.). To the receiver are attached a barrel (with optional sight(s)) and a magazine. Handguns are also usually built to be disassembled into their constituent parts and then reassembled. This allows for the individual components of the handguns (e.g., the receiver) to be replaced with modified components that can be designed for specific uses or as enhancements to the original manufacturer's design.

Examples of handguns with which the present invention can be used include the Glock family (e.g., 17, 19, 22, etc.), the Sig Sauer family (P220, P226, and P229), Baretta 92F, Springfield Armory Shield (SMSc), and Smith and Wesson M&P 9.

In some aspects, there is described a novel handgun receiver (2), comprising:

a. a grip (7) having a top and bottom and a front and a back, wherein a grip opening (8) is present in the bottom of the grip (7), the grip opening (8) configured to receive a magazine (9) and the grip (7), further comprises:
   i. a data transmitter (5) in electronic communication with a power source (4) and a camera (3);

b. a trigger assembly (10);

c. a trigger guard (11) having a top and bottom and a front and a back, wherein the trigger guard (11) is located adjacent to the front of the grip (7) and at least partially circumscribes the trigger assembly (10); and, d. a receiver length (12) affixed to the top of the grip (7) and top of the trigger guard (11) and extending distal to the trigger guard (11), wherein the receiver length (12), comprises:
   i. a first cavity (13) adjacent to the front of the trigger guard (11);
   ii. the camera (3) housed in the first cavity (13);
   iii. a second cavity (14) adjacent to the front of trigger guard (11); and,
   iv. the power source (4) housed in the second cavity (14).

In some aspects, the power source (4) is rechargeable. In some aspects, the power source (4) is configured for wireless recharging.

The camera (3) is in electronic communication with both the power source (4) and the data transmitter (5). In some aspects, the electronic communication between the data transmitter (5) and power source (4) and camera (3) is a molded in power transfer system (15) that spans the gap between the front of the receiver (2) and the grip (7).

In some aspects, the power source (4) is configured to recharge via charge points (6). The charge points (6) are configured to receive an electrical charge when brought into contact with an electrical source. In these aspects, the power source (4), further comprises:

a. charge points (6).

In some aspects, the power source (4), further comprises:

a. a laser sight (16).

The laser sight (16) can be configured to operate in conjunction with the camera (3) or independent of the camera (3). This allows the laser sight (16) to be turned on or off without affecting the operation of the camera (3).

In some aspects, the camera (3), further comprises:

a. a microphone (17); and/or b. one or more light-emitting diodes (18) (LEDs).

The microphone (17) is typically configured to operate in conjunction with the camera (3). So, when the camera (3) is activated, the microphone (17) is activated.

The LED(s) (18) is typically configured to operate in conjunction with the camera (3). So, when the camera (3) is activated, the LED(s) (18) is activated.

Alternatively, in some aspects, the power source (4), further comprises: one or more LEDs (18). Typically, in these aspects, the camera (3), further comprises: a laser sight (16). In other aspects, the power source (4), further comprises: both LEDs (18) and a laser sight (16). In other aspects, the camera (3), further comprises: both LEDs (18) and a laser sight (16).

In some aspects, the first cavity (13) is configured with electronic ports (not shown) to receive the camera (3). These ports can be optionally configured to receive an electronic plug(s). Alternatively, the ports can be electrical contacts. In these aspects, the camera (3) is plugged into the first cavity (13). This type of configuration allows for the camera (3) to be replaceable (e.g., a plug-n-play configuration).

In some aspects, the camera (3) is partially enclosed within the first cavity (13) via a door (not shown) or cover (not shown). The door or cover comprises an opening to allow the camera (3) to record images (and optionally sound when a microphone (17) is present).

When a plurality of LEDs (18) is present (e.g., 2, 3, or 4), they are typically evenly spaced around the front of the camera (3). The output of the LED can vary depending on the needs of the use. Examples of the number of lumens produced by each LED (or the combination when a plurality is present) include 300, 400, 500, 600, 700, 800, 900, 1000, 1100, 1200, 1300, 1400, 1500, 1600, 1700, 1800, 1900, 2000, 2100, 2200, 2300, 2400, 2500, 2600, 2700, 2800, 2900, 3000, 3100, 3200, 3300, 3400, 3500, 3600, 3700, 3800, 3900, 4000, 4100, 4200, 4300, 4400, 4500, 4600, 4700, 4800, 4900 and 5000.

In another aspect, the laser sight (16), comprises: an electronic board, comprising at least one diode laser, wherein the electronic board is in electrical contact with the power source (4).

In another aspect, the light produced by the LED(s) (18) and/or laser is white. In alternative aspects, one or more colors are produced (e.g., white, green, blue, and/or red).

In some aspects, the second cavity (14) is configured with electronic ports to receive the power source (4). These ports can be openings configured to receive an electronic plug or plugs. Alternatively, the ports can be electrical contacts. In these aspects, the power source (4) is plugged into the second cavity (14). This type of configuration allows for the power source (4) to be replaceable (e.g., a plug-n-play configuration).

In some aspects, the power source (4) is partially or fully enclosed within the second cavity (14) via a door or cover.

Figure 2:
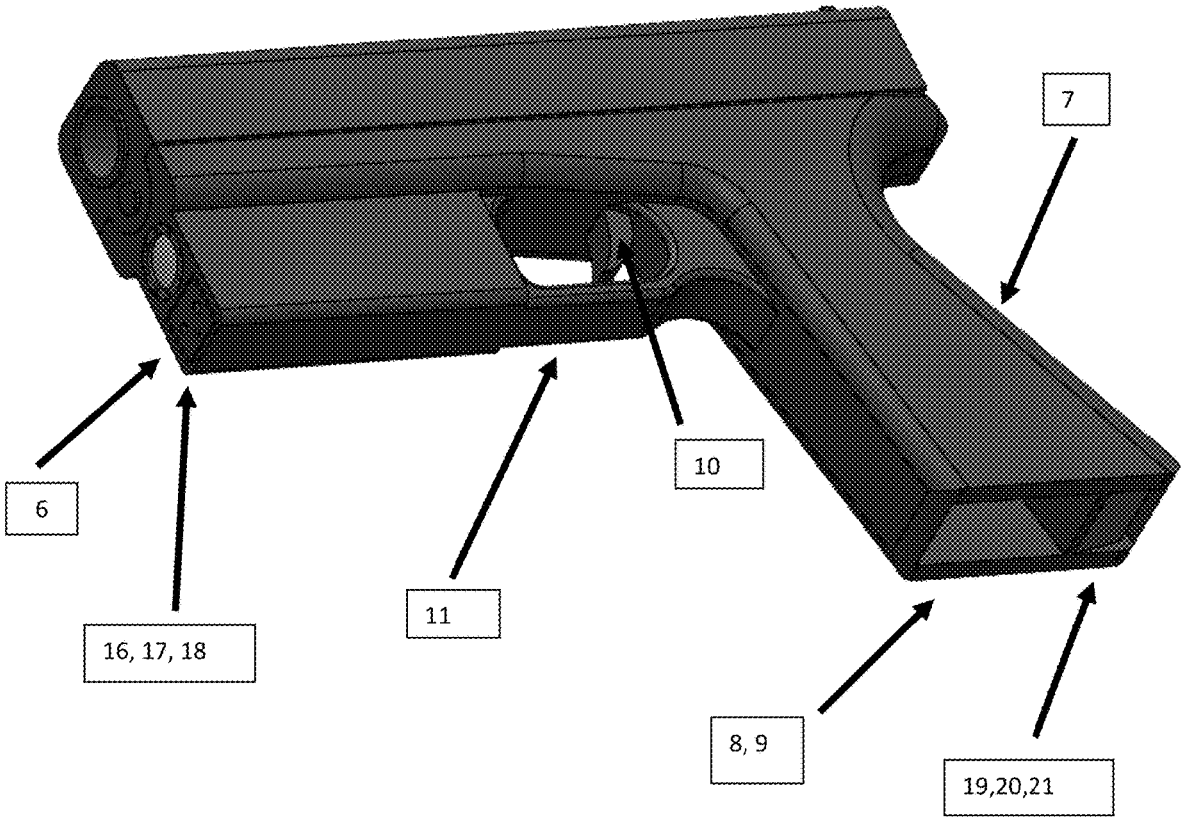
FIG. 2 shows an assembled view of a modified Glock 22.

In some aspects, the second cavity (14) is separated from the receiver length (12) by the first cavity (13) (see FIGS. 1-2). This stacked configuration allows for the cavities to be of a similar width to the receiver (and in some aspects of a similar width of the trigger guard).

Alternatively, in some aspects, the second cavity (14) is parallel to the first cavity (13)(e.g., side-by-side underneath the receiver)(not shown). This configuration would typically result in the receiver being wider beyond the trigger guard (11).

In some aspects, the data transmitter (5) in electronic communication with the camera (3) and power source (4), further comprises:

a. a video data transfer and proximity switch (19);

b. a proximity sensor (20); and, c. a control circuit (21).

The proximity switch (19) is configured to activate the electronics of the receiver (2), including the camera (3). The proximity sensor (20) sends a signal to a control circuit (21) to turn on once it is no longer within range (e.g., 1", 2", 3", 4", 5", 6", 7", 8", 9", 10", 11", to 1' or more) of a base module (22). In some aspects, the base module (22) is a handgun holster. As an example, when the handgun is withdrawn from the holster (e.g., base module (22)), the proximity sensor (20) detects the separation from the base module (22) and activates the proximity switch (19). The proximity switch (19) then activates the electronics (e.g., control circuit (21)) and camera (3) and the camera (3) begins recording. Other electronics present (e.g., microphone, LED, and laser), if present, are also activated by the proximity switch (19).

In some aspects, the data transmitter (5), further comprises a storage device (23) (e.g., solid state memory). In some aspects, camera (3) activation refers to the camera (3) recording video onto a storage device (23) present in the receiver (2). The storage device (23) allows the camera (3) to record and the recording (e.g., saved data) to be transmitted later (e.g., when the data transmitter (5) is in electronic range of or connected to a base module (22)). Alternatively, the storage device (23) can be configured to be removable (e.g., a SD card).

In some aspects, the data transmitter (5), is configured for "live" streaming of the images captured by the camera (3) (and other optional components such as microphone (17)). The data can be transmitted via a cellular, Wi-Fi, or other type of wireless transmitter to a base port (24) (e.g., a substation configured to communicate with the handgun). Alternatively, base module (22) can further comprise a second data transmitter (25)(not shown) that is configured to transmit via a cellular, Wi-Fi, or other type of wireless transmitter to a base port (24). With either of the above configurations, this would allow the images from the camera (3) to be transmitted live to a third party (e.g., a local or distant tactical station such as a local law enforcement department).

In some aspects, the data transmitter (5), including the proximity switch (19) and control circuit (21), is housed within the grip (7) of the receiver (2). For example, in some aspects, the grip (7), comprises an opening on the bottom or side that is configured to house the data transmitter (5). This would place the data transmitter (5) adjacent to a magazine (9) when present. In some aspects, the grip (7) is configured with electronic ports (not shown) to receive the data transmitter (5). These ports can be openings configured to receive an electronic plug or plugs. Alternatively, the ports can be electrical contacts. In these aspects, the data transmitter (5) is plugged into the grip (7) (e.g., into the bottom or side of the grip (7)). This type of configuration allows for the data transmitter (5) to be replaceable (e.g., a plug-n-play configuration).

In some aspects, the data transmitter (5) is enclosed within the grip (7) via a door or cover (not shown)

In some aspects, the data transmitter (5) and second data transmitter (25) are independently configured to transfer data via Bluetooth, Wi-Fi, Zigbee, cellular, or another wireless data transfer protocol. The data from data transmitter (5) is transferred from the receiver (2) to a base port (24). In some aspects, the data transmitter (5) is configured with software that automatically initiates data transfer (e.g., once recording has started or stopped or once the is in within range of a base module (22)). In some aspects, this automatic data transfer is initiated with the proximity switch (19). In these aspects, the proximity switch (19) is configured to automatically initiate a transfer of any video and/or audio recordings when the handgun is within a certain distance of the base port (24) (e.g., a substation configured to communicate with the handgun).

Alternatively, the data transmitter (5) is configured to transfer data via a wired connection. This configuration can be in addition to the wireless configuration. In these aspects, the data is transferred when a wire, cable, or electrical connection is made between the data transmitter (5) and a base port (24). This transfer can be configured to be automatic (transfer initiated upon connection) or can be require user intervention (e.g., a user must access software and/or grant permission before data transfer is initiated).

The receiver (2) is configured to receive a handgun slide (1) (or upper portion of a handgun). The slide (1) typically comprises: a slide frame, a barrel substantially housed in the slide (1) frame, and a firing pin assembly (not shown).

The following table provides a description of the structures in the figures as well as other unnumbered structures or structures not shown.

| # | Structure |
|---|---|
| 1 | Handgun slide (or upper) |
| 2 | Handgun receiver (or lower) |
| 3 | Camera |
| 4 | Power source |
| 5 | Data transmitter |
| 6 | Charge points |
| 7 | Grip |
| 8 | Grip opening |
| 9 | Magazine (not shown) |
| 10 | Trigger assembly |
| 11 | Trigger guard |
| 12 | Receiver length (not numbered) |
| 13 | First cavity (not numbered) |
| 14 | Second cavity (not numbered) |
| 15 | Power transfer system (not numbered) |
| 16 | Laser sight |
| 17 | Microphone |
| 18 | Light-emitting diode(s) |
| 19 | Proximity switch |
| 20 | Proximity sensor |
| 21 | Control circuit |
| 22 | Base module (not shown) |
| 23 | Storage device (not shown) |
| 24 | Base port (not shown) |
| 25 | Second data transmitter (not shown) |

In another aspect, the receiver (2), specifically the electronic components thereof, is weather, water, pressure, and temperature resistant, which allows for typical day-to-day user environments as well as the tactical or operational user (e.g., law enforcement, military, security, etc.).

Numerous modifications and variations of the present invention are possible in light of the above teachings. It is therefore to be understood that within the scope of the appended claims, the invention may be practiced otherwise that as specifically described herein.

What is claimed:

1. A camera-integrated handgun receiver, comprising:

a. a grip (7) having a top and bottom and a front and a back, wherein an grip opening (8) is present in the bottom of the grip (7), the grip opening (8) configured to receive a magazine (9) and the grip (7), further comprises:

i. a data transmitter (5) in electronic communication with a power source (4) and a camera (3);

b. a trigger assembly (10);

c. a trigger guard (11) having a top and bottom and a front and a back, wherein the trigger guard (11) is located adjacent to the front of the grip (7) and at least partially circumscribes the trigger assembly (10); and, d. a receiver length (12) affixed to the top of the grip (7) and top of the trigger guard (11) and extending distal to the trigger guard (11), wherein the receiver length (12), comprises:

i. a first cavity (13) adjacent to the front of the trigger guard (11);

ii. the camera (3) housed in the first cavity (13);

iii. a second cavity (14) adjacent to the front of trigger guard (11); and, iv. the power source (4) housed in the second cavity (14).

2. The handgun receiver of claim 1, wherein the power source (4) is rechargeable.

3. The handgun receiver of claim 1, wherein the power source (4) is configured for wireless recharging.

4. The handgun receiver of claim 1, wherein camera (3) is in electronic communication with both the power source (4) and the data transmitter (5).

5. The handgun receiver of claim 1, wherein the power source (4) is configured to recharge via charge points (6).

6. The handgun receiver of claim 5, wherein the power source (4), comprises: charge points (6).

7. The handgun receiver of claim 1, wherein the power source (4), comprises: a laser sight (16).

8. The handgun receiver of claim 1, wherein the camera (3), comprises:

a. a microphone (17); and/or b. one or more light-emitting diodes (18) (LEDs).

9. The handgun receiver of claim 1, wherein the power source (4), comprises: one or more LEDs (18).

10. The handgun receiver of claim 9, wherein the camera (3), comprises: a laser sight (16).

11. The handgun receiver of claim 1, wherein the power source (4), comprises: one or more LEDs (18) and a laser sight (16).

12. The handgun receiver of claim 1, wherein the camera (3), comprises: one or more LEDs (18) and a laser sight (16).

13. The handgun receiver of claim 1, wherein the first cavity (13), comprises: electronic ports to receive the camera (3).

14. The handgun receiver of claim 1, wherein the first cavity (13), comprises: a door or cover configured to partially enclose camera (3), the door or cover, comprising: an opening to allow the camera (3) to record images.

15. The handgun receiver of claim 10, wherein the laser sight (16), comprises: an electronic board, comprising at least one diode laser, wherein the electronic board is in electrical contact with the power source (4).

16. The handgun receiver of claim 1, wherein the second cavity (14), comprises: electronic ports to receive the power source (4).

17. The handgun receiver of claim 1, wherein the second cavity (14), comprises: a door or cover configured to partially or fully enclose the power source (4).

18. The handgun receiver of claim 1, wherein the data transmitter (5) is in electronic communication with the camera (3) and the power source (4), further comprises:

a. a proximity switch (19);

b. a proximity sensor (20); and, c. a control circuit (21).

19. The handgun receiver of claim 1, wherein the data transmitter (5), further comprises a storage device (23).

20. The handgun receiver of claim 1, wherein the data transmitter (5), including the proximity switch (19) and control circuit (21), is housed within the grip (7) of the receiver (2).

21. The handgun receiver of claim 1, wherein the grip (7), comprises: electronic ports to receive the data transmitter (5).

22. The handgun receiver of claim 1, wherein a tactical rail is absent from the receiver length (12).

* * * * *